US012435954B2

(12) United States Patent
Beck

(10) Patent No.: US 12,435,954 B2
(45) Date of Patent: Oct. 7, 2025

(54) FLEXIBLE BODY ARMOR

(71) Applicant: TYR Tactical, LLC, Peoria, AZ (US)

(72) Inventor: Jason Beck, Peoria, AZ (US)

(73) Assignee: TYR Tactical, LLC, Peoria, AZ (US)

( * ) Notice: Subject to any disclaimer, the term of this patent is extended or adjusted under 35 U.S.C. 154(b) by 0 days.

(21) Appl. No.: 18/363,614

(22) Filed: Aug. 1, 2023

(65) Prior Publication Data

US 2024/0167792 A1 May 23, 2024

Related U.S. Application Data

(63) Continuation of application No. 17/035,473, filed on Sep. 28, 2020, now Pat. No. 11,713,945, which is a continuation of application No. 15/419,052, filed on Jan. 30, 2017, now Pat. No. 10,788,293, which is a continuation of application No. 15/374,498, filed on Dec. 9, 2016, now Pat. No. 9,851,181, which is a continuation of application No. 15/257,745, filed on Sep. 6, 2016, now abandoned, which is a continuation-in-part of application No. PCT/US2016/040989, filed on Jul. 5, 2016, and a continuation-in-part of application No. 14/497,508, filed on Sep. 26, 2014, now Pat. No. 10,591,256, and a continuation-in-part of application No. 14/497,486, filed on Sep. 26, 2014, now Pat. No. 9,435,614, and a continuation-in-part of application No. 13/161,322, filed on Jun. 15, 2011, now abandoned.

(60) Provisional application No. 62/289,089, filed on Jan. 29, 2016, provisional application No. 62/188,595, filed on Jul. 3, 2015, provisional application No.

(Continued)

(51) Int. Cl.

| | |
|---|---|
| ***F41H 1/02*** | (2006.01) |
| ***A41D 1/04*** | (2006.01) |
| ***F41H 5/013*** | (2006.01) |
| ***F41H 5/04*** | (2006.01) |

(52) U.S. Cl.

CPC ..... *F41H 1/02* (2013.01); *A41D 1/04* (2013.01); *F41H 5/013* (2013.01); *F41H 5/0471* (2013.01); *F41H 5/0478* (2013.01); *F41H 5/0485* (2013.01)

(58) Field of Classification Search

None

See application file for complete search history.

(56) References Cited

U.S. PATENT DOCUMENTS 4,287,607 A * 9/1981 Leach ..... F41H 1/02 2/2.5
5,104,727 A * 4/1992 Wnenchak ..... B60R 21/235 442/268

(Continued)

FOREIGN PATENT DOCUMENTS

WO WO-2004109216 A2 * 12/2004 ..... F41H 5/0428
WO WO-2018178103 A1 * 10/2018 ..... D03D 1/0052

*Primary Examiner* — Arti Singh-Pandey
(74) *Attorney, Agent, or Firm* — KW Law, LLP

(57) ABSTRACT

Implementations described and claimed herein provide a ballistic filler for a flexible soft body armor and methods of manufacturing the same. In one implementation, a first portion having a first subpanel is stitched directly to a second subpanel with a stitching pattern. The first subpanel has one or more layers of woven fabric, and the second subpanel has one or more layers of unidirectional fabric. A second portion backs the first portion. The second portion has one or more layers of unstitched unidirectional fabric.

8 Claims, 10 Drawing Sheets

Related U.S. Application Data

61/883,140, filed on Sep. 26, 2013, provisional application No. 61/883,121, filed on Sep. 26, 2013, provisional application No. 61/384,560, filed on Sep. 20, 2010, provisional application No. 61/355,089, filed on Jun. 15, 2010.

(56) References Cited

U.S. PATENT DOCUMENTS

| | | | | |
|---|---|---|---|---|
| 6,161,738 | A * | 12/2000 | Norris | A45C 9/00 383/119 |
| 6,219,842 | B1 * | 4/2001 | Bachner, Jr. | A41D 31/245 2/2.5 |
| 11,543,214 | B2 * | 1/2023 | Citterio | F41H 5/0478 |
| 2003/0104739 | A1 * | 6/2003 | Jenkins | B32B 5/28 442/248 |
| 2005/0193480 | A1 * | 9/2005 | Carlson | F41H 1/02 2/463 |
| 2006/0135022 | A1 * | 6/2006 | Porter | B29C 66/72141 442/381 |
| 2014/0082808 | A1 * | 3/2014 | Chiou | F41H 5/0471 2/2.5 |

* cited by examiner

FLEXIBLE BODY ARMOR

CROSS-REFERENCE TO RELATED APPLICATIONS

The present patent application is a continuation of and claims priority to U.S. Nonprovisional paten application Ser. No. 17/035,473 filed on Sep. 28, 2020 and entitled "FLEXIBLE BODY ARMOR," which is a continuation of and claims priority to U.S. Nonprovisional patent application Ser. No. 15/419,052 filed on Jan. 30, 2017 and entitled "FLEXIBLE BODY ARMOR," which is a continuation of and claims priority to U.S. Nonprovisional patent application Ser. No. 15/374,498 filed on Dec. 9, 2016 and entitled "PERSONAL TACTICAL SYSTEM," which is a continuation of and claims priority to U.S. Nonprovisional patent application Ser. No. 15/257,745 filed on Sep. 6, 2016 and entitled "PERSONAL TACTICAL SYSTEM" (the "745 application").

The '745 application is a continuation-in-part of Patent Cooperation Treaty Application No. PCT/US2016/040989, entitled "Female Protective Vest" and filed on Jul. 5, 2016, which claims priority under 35 U.S.C. § 119 to U.S. Provisional Application No. 62/188,595, entitled "Female Protective Vest" an filed on Jul. 3, 2015.

The '745 application is further a continuation-in-part of U.S. patent application Ser. No. 14/497,508, entitled "Ballistic Vest System with Ballistic Ridge Component" and filed on Sep. 26, 2014, which claims priority under 35 U.S.C. § 119 to U.S. Provisional Application No. 61/883,140, entitled "Ballistic Vest System with Ballistic Ridge Component" an filed on Sep. 26, 2013.

The '745 application is further a continuation-in-part of U.S. patent application Ser. No. 14/497,486, entitled "Ballistic Vest System with Ballistic Vein Component" and filed on Sep. 26, 2014, now U.S. Pat. No. 9,435,614 issued Sep. 6, 2016, which claims priority under 35 U.S.C. § 119 to U.S. Provisional Application No. 61/883,121, entitled "Ballistic Vest System with Ballistic Vein Component" an filed on Sep. 26, 2013.

The '745 application is further a continuation-in-part of U.S. patent application Ser. No. 13/161,322, entitled "High Performance Composite Fabric" and filed on Jun. 15, 2011, which claims priority under 35 U.S.C. § 119 to U.S. Provisional Application No. 61/384,560, entitled "Textile Articles Incorporating High Performance Composite Fabric" and filed on Sep. 20, 2010 and to U.S. Provisional Application No. 61/355,089, entitled "Kevlar Backed Nylon Tactical Material" and filed on Jun. 15, 2010.

The present patent application is a continuation of and claims priority to U.S. Nonprovisional Paten application Ser. No. 17/035,473 filed on Sep. 28, 2020 and entitled "FLEXIBLE BODY ARMOR," which is a continuation of and claims priority to U.S. Nonprovisional patent application Ser. No. 15/419,052 filed on Jan. 30, 2017 and entitled "FLEXIBLE BODY ARMOR," which is claims priority under 35 U.S.C. § 119 to U.S. Provisional Application No. 62/289,089, entitled "Flexible Body Armor" and filed on Jan. 29, 2016.

Each of the above-referenced applications is incorporated by reference herein in its entirety for any purpose.

TECHNICAL FIELD

Aspects of the present disclosure relate to ballistic filler for flexible body armor and more particularly to ballistic filler comprising a woven fabric stitched to unidirectional laminates and methods of manufacturing the same.

BACKGROUND

Ballistic gear, including vests, carriers, belts, cummerbunds, ballistic accessories (e.g., shoulder protection, pouches, abdomen protection, groin protection, leg protection, bicep/deltoid upper arm protection, etc.) and the like are worn by a human or animal to absorb the impact from and resist penetration to the body from ballistic projectiles and shrapnel from explosions. Such ballistic gear often includes soft body armor, which provides ballistic resistance while reducing an overall weight of the ballistic gear. The assembly of multiple plies of anti-ballistic textile structures generated from high strength fibers in soft body armor designs is often referred to as the ballistic filler. The number and type of anti-ballistic textile ply structures used in the ballistic filler is chosen based on the desired level of threat protection, comfort, and material cost. Typically, the ballistic filler of conventional ballistic gear achieves a compromise in performance at best. More particularly, conventional ballistic filler: improves flexibility at the expense of increased back face deformation; improves back face deformation performance at the expense of flexibility, mechanical fatigue resistance, and fragmentation threat resistance; or improves durability and ballistic performance at the expense of slip and translation resistance during a ballistic impact. It is with these observations in mind, among others, that various aspects of the present disclosure were conceived and developed.

SUMMARY

Implementations described and claimed herein address the foregoing problems by providing a ballistic filler comprising a woven fabric stitched to a unidirectional laminate and methods of manufacturing the same. In one implementation, a first portion having a first subpanel is stitched directly to a second subpanel with a stitching pattern. The first subpanel has one or more layers of woven fabric, and the second subpanel has one or more layers of unidirectional fabric. A second portion backs the first portion. The second portion has one or more layers of unstitched unidirectional fabric.

In another implementation, an interior is formed by an outer layer and an inner layer. A flexible body armor is insertable into the interior. The flexible body armor has a front panel comprising a first subpanel of one or more layers of woven fabric stitched directly to a second subpanel of one or more layers of unidirectional fabric. The second subpanel backs the first subpanel.

In yet another implementation, a first subpanel of one or more layers of woven fabric is formed, and a second subpanel of one or more layers of unidirectional fabric is formed. The first subpanel is stitched to the second subpanel to form a first panel with a stitching pattern. The second subpanel backs the first subpanel. A plurality of layers of unidirectional fabric is stitched to form a second panel. A third panel having one or more layers of unstitched unidirectional fabric is formed. The third panel is arranged backing the second panel and the second panel backing the first panel. The first panel, the second panel, and the third panel are attached together to form the flexible body armor.

In still another implementation, a first region comprises one or more flexible ballistic ply structures generated from a high strength yarn backing a stitch consolidated assembly of one or more plies of woven fabric generated from ultrahigh molecular weight polyethylene yarn. A second region comprises one or more unstitched ballistic ply structures generated from the high strength yarn.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

BRIEF DESCRIPTIONS OF THE DRAWINGS

DETAILED DESCRIPTIONS

Aspects of the present disclosure involve ballistic filler for flexible body armor insertable or otherwise deployed into ballistic gear. The ballistic fiber comprises at least a portion of woven fabric stitched directly to unidirectional laminates. In one aspect, the woven fabric is generated from ultrahigh molecular weight polyethylene (UHMWPE) fiber, which when used in conjunction with the unidirectional laminates, is effective as anti-ballistic ply structures. A ballistic arrangement of the ballistic filler includes the UHMWPE woven fabric being backed by unidirectional laminates. More specifically, the ballistic arrangement constitutes one or more regions where one or more plies of UHMWPE woven fabric are backed by one or more plies of unidirectional laminates. As used in the present disclosure, respective to each region, "backed" refers to plies residing closer to a wearer, and "fronted" refers to plies closer to a strike face of the ballistic gear. In one particular aspect, one or more of the regions comprised of UHMWPE woven fabric backed by unidirectional laminate are stitched together uniformly using a quilt pattern or some other uniform stitching pattern.

Figure 1:
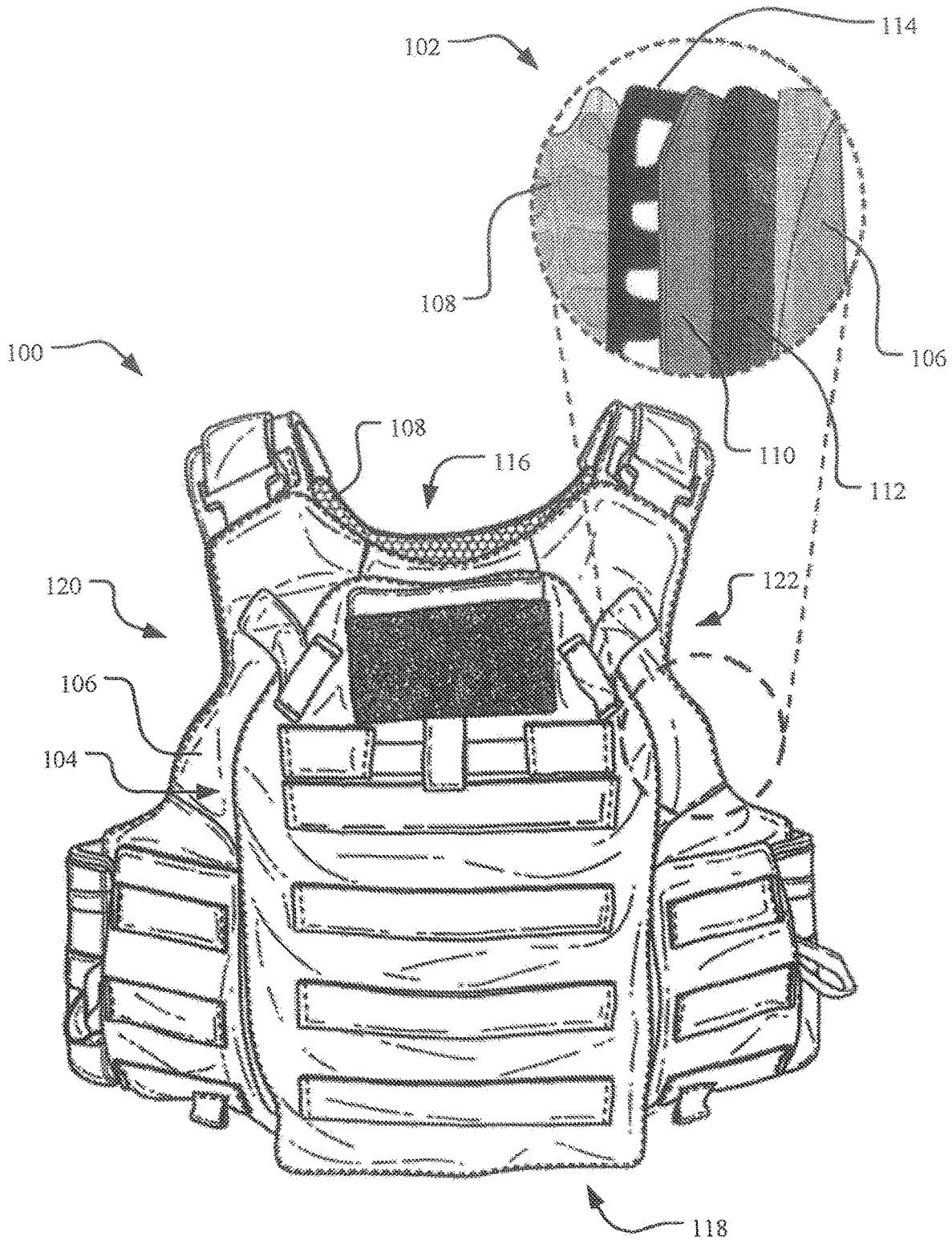
FIG. 1 illustrates an example ballistic vest with interior components shown, including a flexible body armor.

To begin a detailed description of an example ballistic vest 100 for a wearer incorporating aspects of the presently disclosed technology, reference is made to FIG. 1. It will be appreciated that the ballistic vest 100 is provided as an example of ballistic gear that may incorporate aspects of the presently disclosed technology and is not intended to be limiting. Other examples of ballistic gear for a wearer (e.g., humans or animals) that may incorporate aspects of the presently disclosed technology, include, without limitation, carriers, belts, cummerbunds, ballistic accessories (e.g., shoulder protection, pouches, abdomen protection, groin protection, leg protection, bicep/deltoid upper arm protection, etc.) and the like. As such, although discussed herein in the context of a ballistic vest, it will be appreciated that the presently disclosed technology applies to other types of ballistic gear as well.

As can be understood from FIG. 1, in one implementation, the ballistic vest 100 includes one or more interior components 102 insertable or otherwise disposed in an interior 104 of the ballistic vest 100. The interior 104 may be, for example, a pocket or similar enclosure formed by an outer layer 106 and an inner layer 108 of the ballistic vest 100. As shown in FIG. 1, the outer layer 106 is exposed to an outside environment and is distal from the inner layer 108 to the wearer of the ballistic vest 100. Stated differently, the inner layer 108 faces the wearer and the outer layer 106 faces away from the wearer. In one implementation, the outer layer 106 is made from a lightweight hybrid material with superior abrasion, tear, and fire resistance characteristics, while providing load carriage support and improved durability, particularly in high-wear areas, such as corners, edges, seams, and exposed areas. The lightweight hybrid material of the outer layer 106 may be, for example, a laminate of 500-denier nylon and 200-400-denier para-aramid fibers in an ultra-tight weave.

In one implementation, the internal components 102 of the ballistic vest 100 include a flexible body armor 110, a ballistic plate 112, and a frame 114. The internal components 102 increase ballistic protection, decrease side spall and back face deformation, provide structural support to the ballistic vest 100, and/or provide other benefits. The internal components 102 are housed within the interior 104 of the ballistic vest 100 extending between a proximal end 116 and a distal end 118 and a first side 120 and a second side 122. In one implementation, the sides 120-122 are shaped to accommodate the anatomy and movement of the wearer's arms, and the proximal end 116 is shaped to accommodate the anatomy and movement of the wearer's collar and neck area.

The ballistic plate 112 is a hard plate configured to provide ballistic protection against projectiles or shrapnel impacting a strike face of the ballistic plate 112. The strike face is disposed within the interior 104 towards the outer layer 106, with a back face disposed towards the inner layer 108. In one implementation, a ballistic component (not shown) wraps around at least a portion of a periphery of the ballistic plate 112 to provide additional protection against side spall created by augmentation of the ballistic plate 112. Such as ballistic component improves the structure of the interior 104 and enhances area coverage and range of motion for increased ergonomics and performance. In one implementation, such a ballistic component provides approximately one inch of additional ballistic coverage beyond a front edge of the ballistic plate 112 and approximately 0.5 inches of additional ballistic coverage beyond side edges of the ballistic plate 112.

In one implementation, the frame 114 includes a body configured to improving overall load carriage performance of the ballistic vest 100 by providing a rigid platform to add weight. The frame 114 body further reduces fatigue by improving the structure of the ballistic vest 100 by retaining the flexible body armor 110 in a configuration that prevents bunching and provides support to the ballistic plate 112 to improve edge hit protection. The frame 114 is loose from or otherwise unattached to the flexible body armor 110 within the interior 104. The frame 114 absorbs and otherwise dissipates energy from an impact of a projectile against the ballistic plate 112 and/or the flexible body armor 110. The frame 114 body may be solid or have one or more openings therethrough, as shown in FIG. 1.

Figure 2:
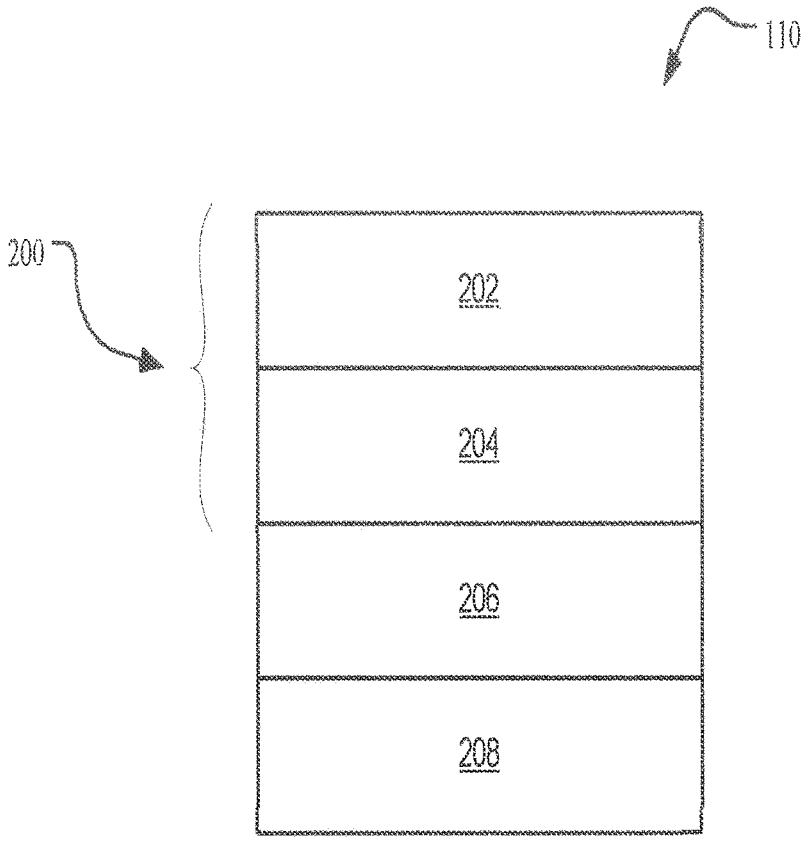
FIG. 2 is a diagram showing example panels of the ballistic filler for the flexible body armor, including a first panel, a second panel, and a third panel.

As can be understood from FIG. 2, in one implementation, ballistic filler for the flexible body armor 110 includes a first panel 200 having a first subpanel 202 and a second subpanel 204, a second panel 206, and a third panel 208. It will be appreciated that the flexible body armor 110 may be insertable into or otherwise provided with ballistic gear, such as the ballistic vest 100, or other types of ballistic gear described herein.

Figure 3:
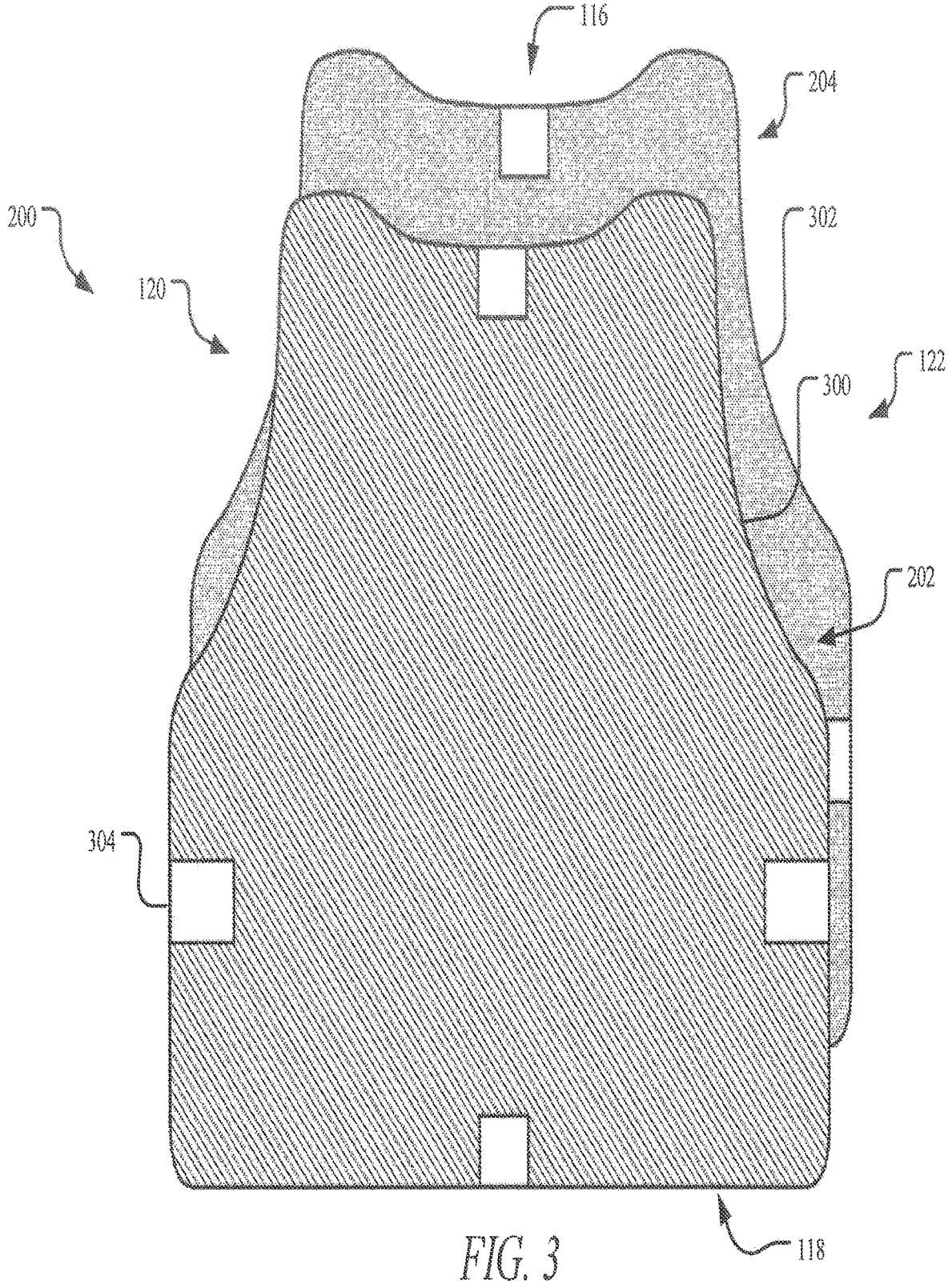
FIG. 3 illustrates the first panel of the ballistic filler, including a first subpanel of woven fabric and a second subpanel of unidirectional laminates.

Referring to FIG. 3, in one implementation, the first panel 200 of the ballistic filler of the flexible body armor 110 includes the first subpanel 202 as a plurality of layers of woven fabric generated from UHMWPE fiber and the second subpanel 204 as a plurality of layers of unidirectional laminate. In one particular implementation, the first subpanel 202 comprises three layers of JPS 17517 woven fabric, and the second subpanel comprises four layers of SB117 unidirectional laminates. Tape 304 holds the layers 300 of the first subpanel 202 together and holds the layers 302 of the second subpanel 204 together.

Figure 4:
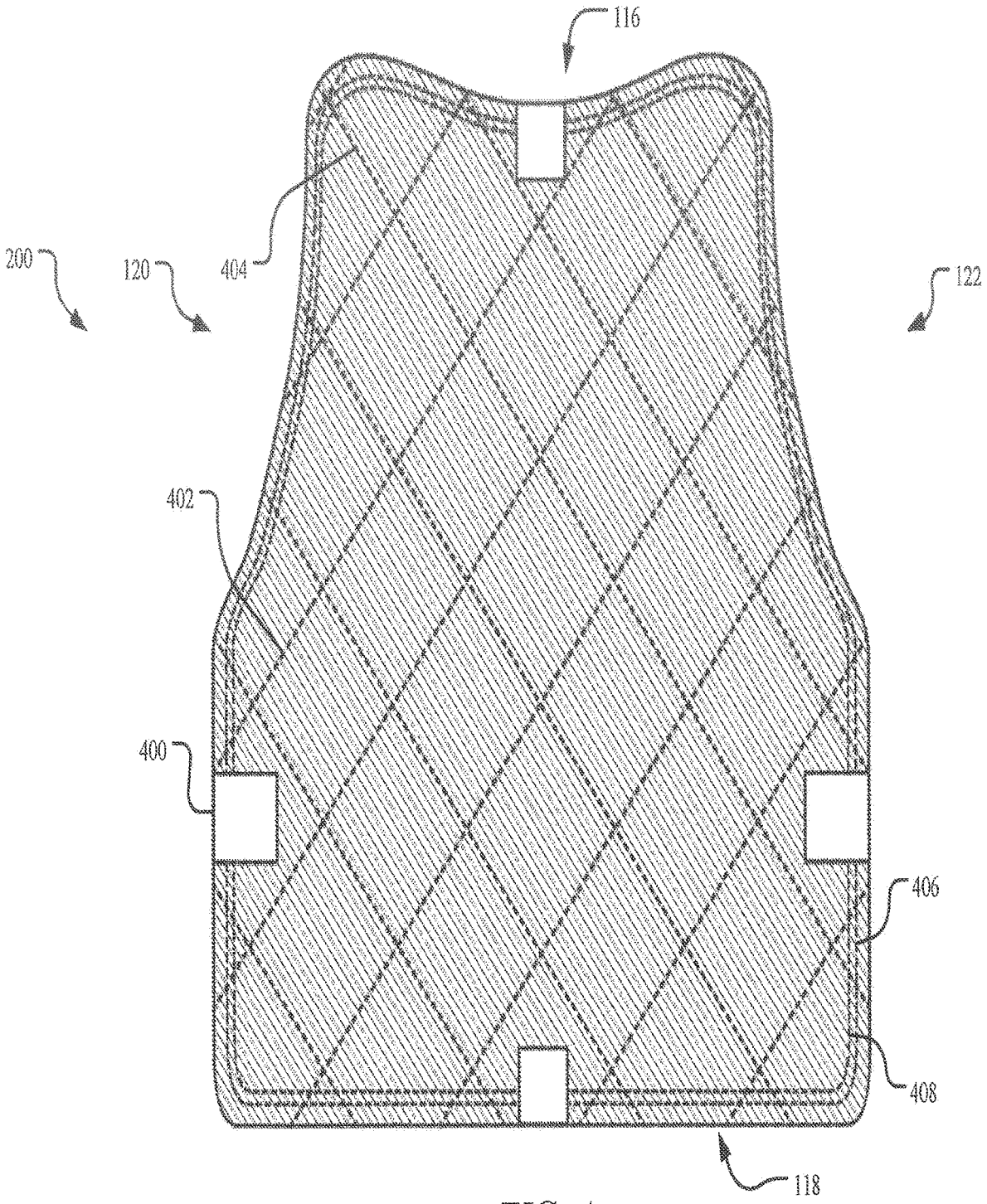
FIG. 4 depicts the first panel of the ballistic filler with the first subpanel stitched directly to the second subpanel.

Turning to FIG. 4, in one implementation, the first subpanel 202 is stitched directly to the second subpanel 204 to form the first panel 200. The first subpanel 202 is backed by the second panel 204. Tape 400 disposed at one or more of the edges may hold the first subpanel 202 to the second subpanel 204 during stitching.

In one implementation, the stitching comprises a first set of stitching lines 402 parallel to each other and oriented in a first direction and a second set of stitching lines 404 parallel to each other and oriented in a second direction. The first direction may be perpendicular to the second direction to form a quilted square pattern. In one implementation, the first direction and the second direction are both diagonal relative to the proximal end 116 and the distal end 118. Other stitching methods and arrangements are contemplated. In one implementation, a first edge stitching 406 and a second edge stitching 408 extend around a perimeter of the first panel 200 at a distance from the edge (e.g., approximately ¼ inches and ½ inches from the edge with +/−⅛ inches apart).

Figure 5:
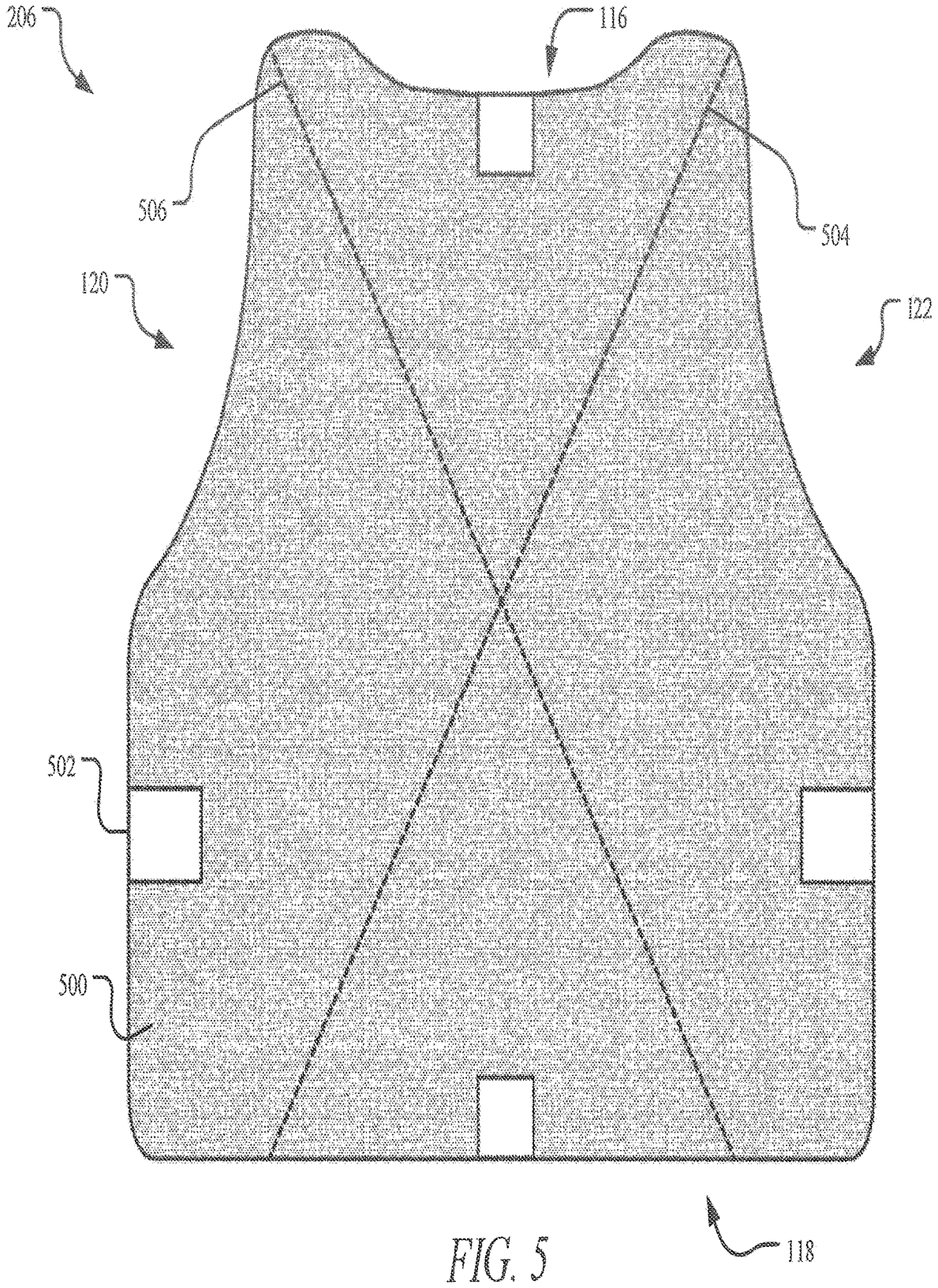
FIG. 5 shows the second panel of the ballistic filler formed from a plurality of stitched layers of unidirectional laminates.

Turning to FIG. 5, the second panel 206 of the ballistic filler for the flexible body armor 110 is shown. In one implementation, the second panel 206 is formed from a plurality of layers 500 of unidirectional laminates. In one implementation, the plurality of layers 500 is fifteen layers of SB115. The plurality of layers 500 may be held together with tape 502 for stitching. In one implementation, the stitching comprises a first stitching line 504 and a second stitching line 506. The stitching lines 504 and 506 form an "X' shape across the plurality of layers 500 from the proximal end 116 to the distal end 118, with the ends spaced an equal distance such that if the proximal and distal end points of the stitching lines 504 and 506 were joined a rectangle would be formed.

Figure 6:
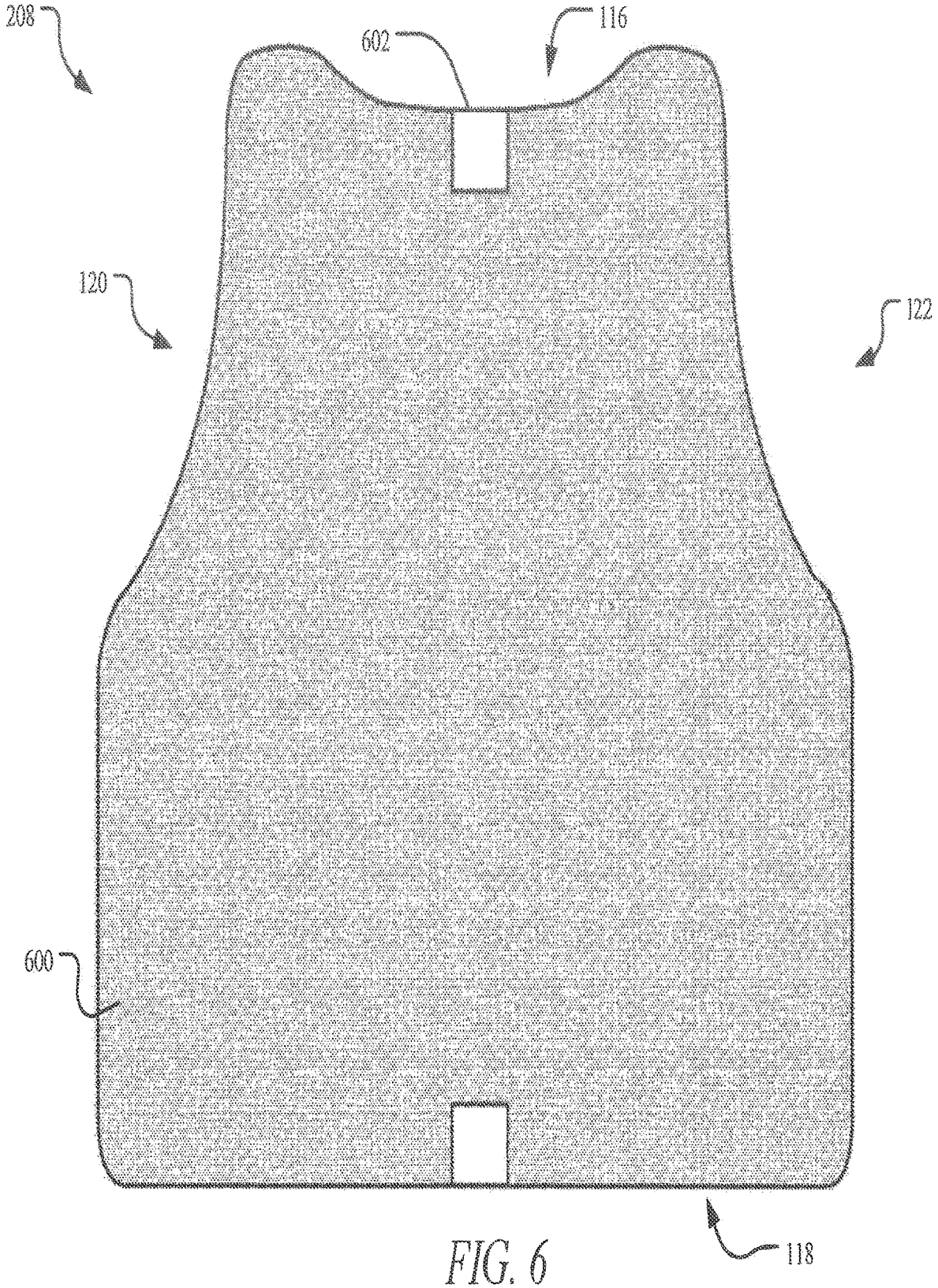
FIG. 6 illustrates the third panel of the ballistic filler formed by a plurality of layers of unidirectional laminates.

FIG. 6 illustrates the third panel 208 of the ballistic filler for the flexible body armor 110 formed by a plurality of layers 600 of unidirectional laminates. In one implementation, the plurality of layers 600 is two layers of S8117. The plurality of layers 600 are not sewn and are held together with tape 602 for combining with the first panel 200 and the second panel 206.

Figure 7:
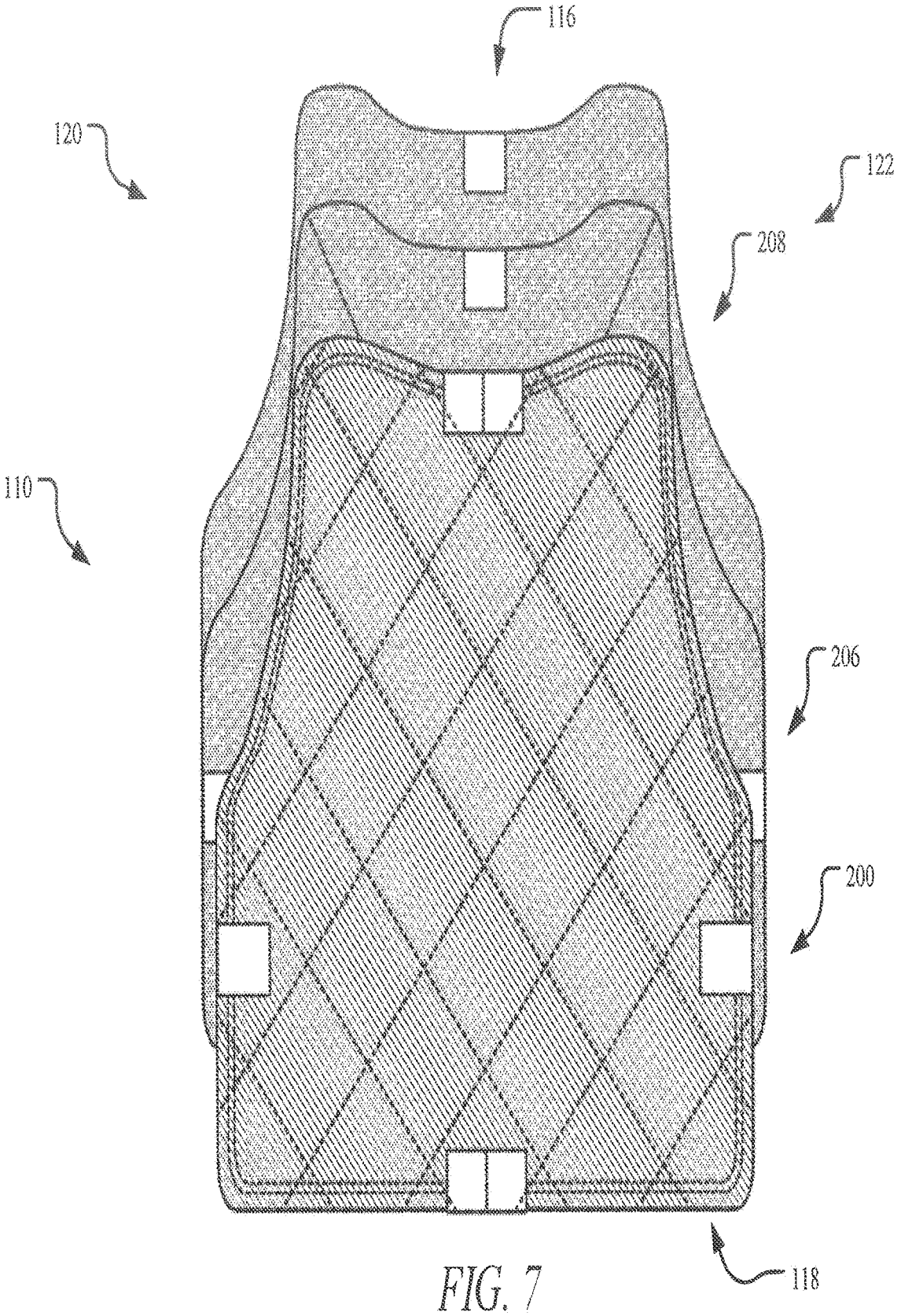
FIG. 7 depicts a ballistic arrangement of the ballistic filler, including the first panel backed by the second panel, which is backed by the third panel.
Figure 8:
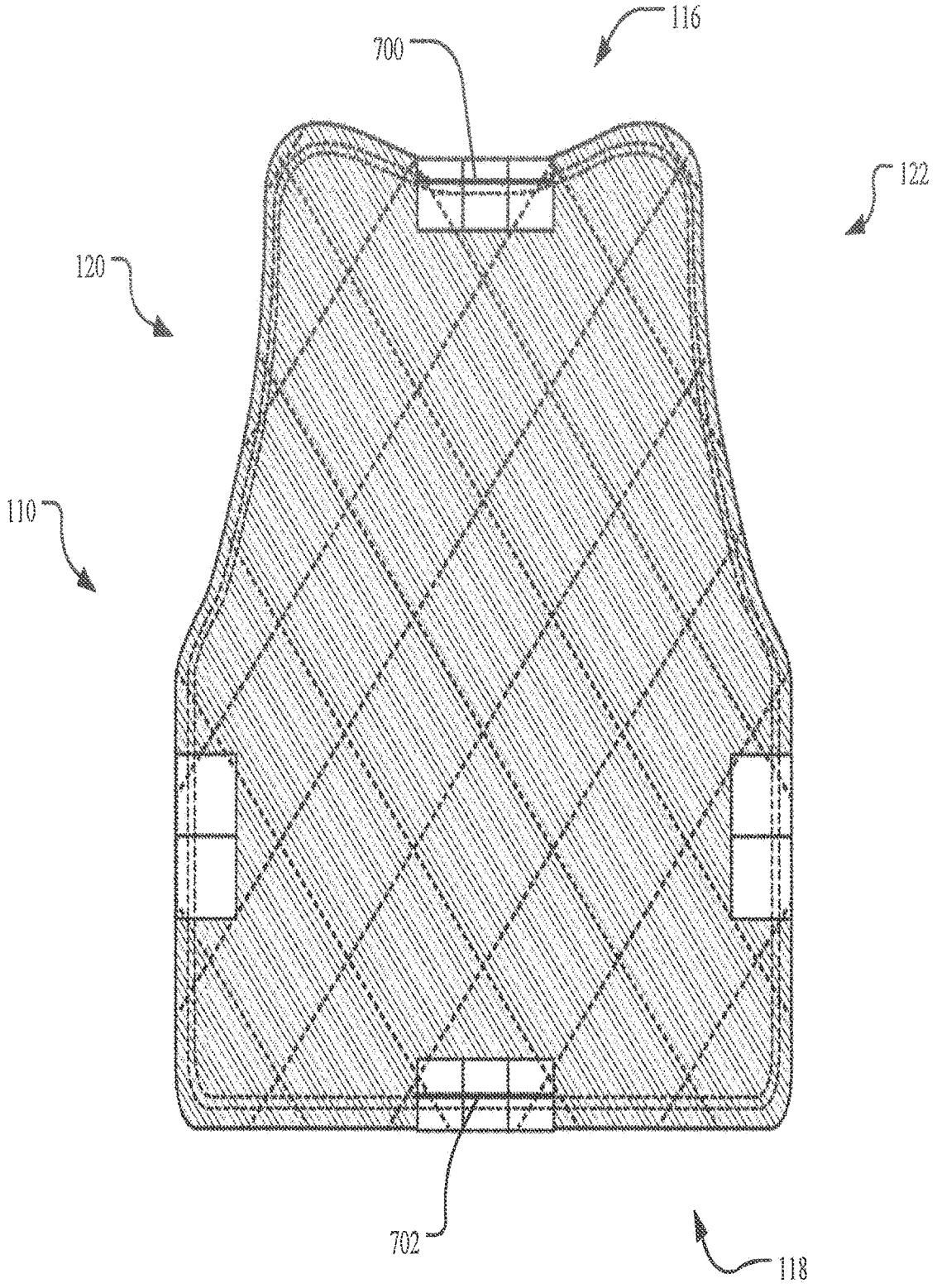
FIG. 8 shows the ballistic filler with the first panel, the second panel, and the third panel connected using closure stitching.
Figure 9:
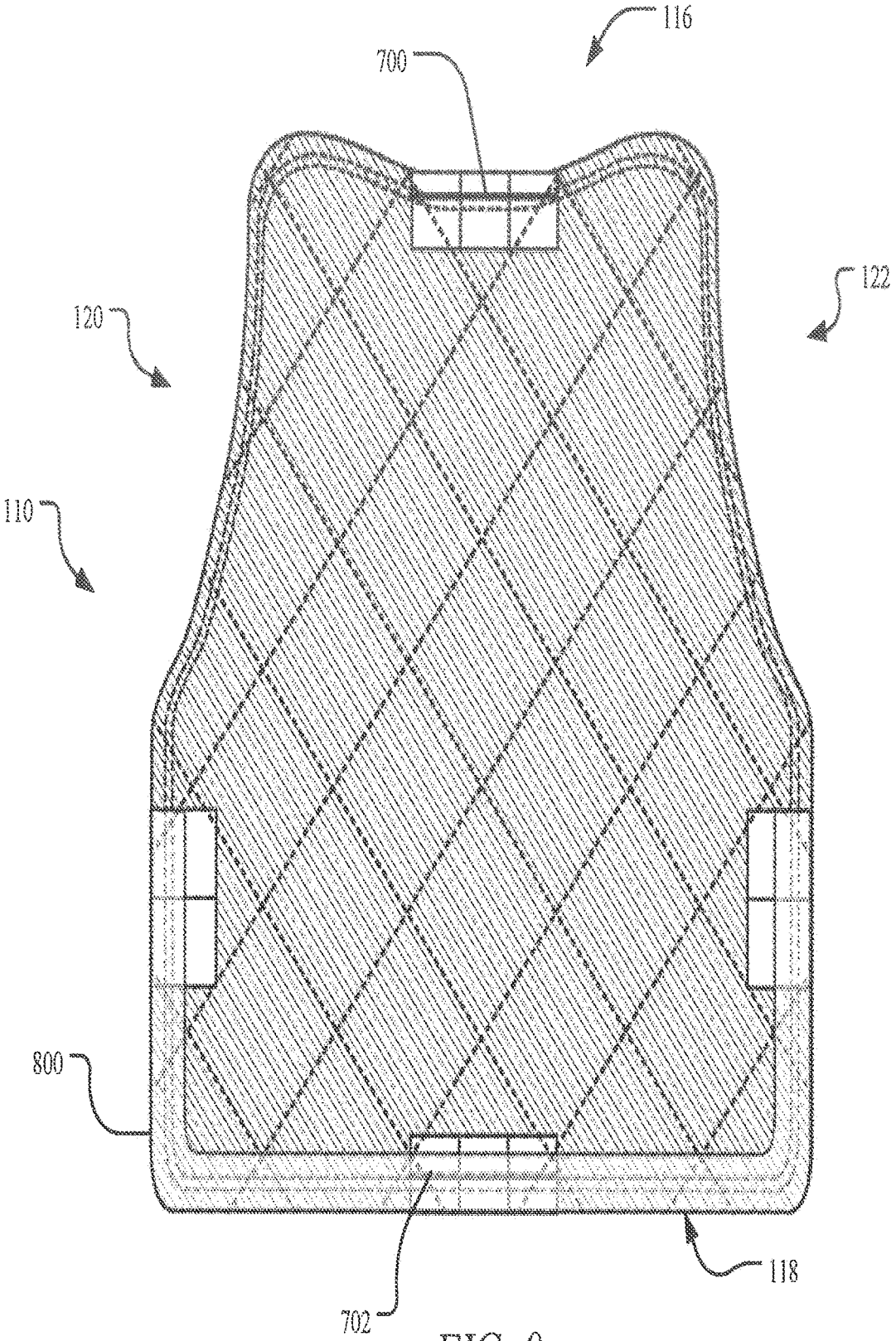
FIG. 9 illustrates edge tape applied to a portion of a periphery of the ballistic filler for heat sealing.

As shown in FIG. 7, a ballistic arrangement of the ballistic filler for the flexible body armor 110, includes the first panel 200 backed by the second panel 206, which is backed by the third panel 208, such that the subpanel 202 of the woven fiber is the layer most proximal to the strike face towards the outer layer 106. FIG. 8 illustrates the ballistic filler for the flexible body armor 110 with the first panel 200, the second panel 206, and the third panel 208 connected using proximal closure stitching 700 and distal closure stitching 702 disposed at the proximal end 116 and the distal end 118, respectively. In one implementation, the closure stitching 700 and 702 comprises two passes of three inch 0/C 1.5 inches left and right. As shown in FIG. 9, edge tape 800 may be applied to a portion of a periphery of the ballistic filler for the flexible body armor 110 for heat sealing.

Figure 10:
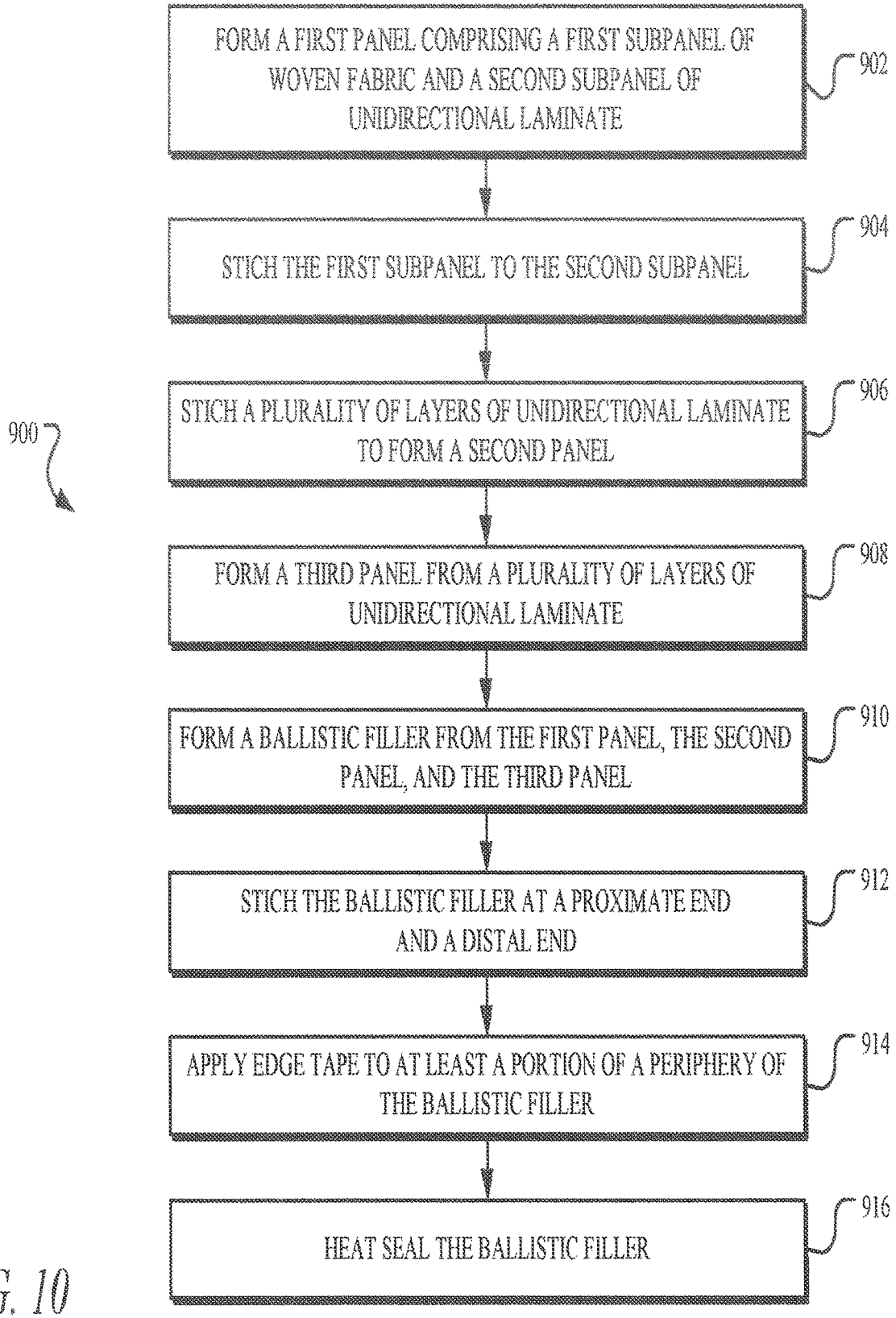
FIG. 10 illustrates example operations for manufacturing a ballistic filler.

FIG. 10 illustrates example operations 900 for manufacturing a ballistic filler, including operations 902-916. In one implementation, an operation 902 forms a first panel comprising a first subpanel of woven fabric and a second subpanel of unidirectional laminate. An operation 904 stitches the first subpanel to the second subpanel. An operation 906 stitches a plurality of layers of unidirectional laminate to form a second panel, and an operation 908 forms a third panel from a plurality of layers of unidirectional laminate. An operation 910 forms a ballistic filler from the first panel, the second panel, and the third panel, and an operation 912 stitches the ballistic filler at a proximal end and a distal end. An operation 914 applies edge tape to at least a portion of a periphery of the ballistic filler, and an operation 916 heat seals the ballistic filler to form the flexible body armor 110.

The ballistic filler for the flexible body armor 110 provides numerous advantages over monolithic and other hybrid designs. For example, the flexible body armor 110 is comfortable, durable, flexible, lightweight, and provides increased performance, including resistance to ballistic penetration, back face deformation performance, resistance to mechanical fatigue, and resistance to fragmentation threat, and the like.

In one implementation, the ballistic filler of the flexible body armor 110 has distinct regions. At least one region comprises a stitch consolidated assembly of one or more plies of woven fabric generated from ultra-high molecular weight polyethylene (UHMWPE) yarn disposed in front of one or more flexible ballistic ply structures generated from a high strength yarn.

The flexible ballistic ply structures may be, for example, a resin impregnated woven fabrics, unidirectional laminates, multi-axial fabrics, and/or the like. In one implementation, the flexible ballistic ply structures can be generated using high strength yarns including, without limitation, aromatic polyamides such as poly(p-phenylene teraphthalamide), poly(metaphenylene isophthalamide), p-phenylenebenzobisoxazole, polybenzoxazole, polybenzothiazole, aromatic unsaturated polyesters such as polyethylene terephthalate, aromatic polyimides, aromatic polyamideimides, aromatic polyesteramideimides, aromatic polyetheramideimides and aromatic polyesterimides or copolymers of any of the above mentioned classes of materials, and UHMWPE, or any combination of these yarns. In another implementation, the flexible ballistic ply structures are woven fabrics generated from high strength fiber are woven structures produced using yarns containing aromatic polyamides including poly (p-phenylene teraphthalamide), poly(metaphenylene isophthalamide), p-phenylenebenzobisoxazole, polybenzoxazole, polybenzothiazole, aromatic unsaturated polyesters such as polyethylene terephthalate, aromatic polyimides, aromatic polyamideimides, aromatic polyesteramideimides, aromatic polyetheramideimides and aromatic polyesterimides or copolymers of any of the above mentioned classes of materials or any combinations of these yarns.

In one implementation, at least one region of the ballistic filler of the flexible body armor 110 comprises one or more plies of unstitched ballistic ply structures generated from a high strength yarn, which may have a tenacity greater than about 7 grams/denier. The unstitched ballistic ply structures may include woven fabrics, resin impregnated woven fabrics, unidirectional laminates, or multi-axial fabrics generated from yarns containing aromatic polyamides including poly(p-phenylene teraphthalamide), poly(metaphenylene isophthalamide), p-phenylenebenzobisoxazole, polybenzoxazole, polybenzothiazole, aromatic unsaturated polyesters such as polyethylene terephthalate, aromatic polyimides, aromatic polyamideimides, aromatic polyesteramideimides, aromatic polyetheramideimides and aromatic polyesterimides or copolymers of any of the above mentioned classes of materials, and UHMWPE or any combinations of these yarns.

Any one of the stitch consolidated assemblies of plies of the ballistic filler for the flexible body armor 110 is achieved using any stitching thread and any type of stitching method to achieve through-thickness connectivity of the plies, including chain stitching or lock stitching to secure all plies in the assembly together. In one implementation, a stitching pattern that is uniform across the surface of the entire assembly is used. Such a uniform stitching pattern may be, for example, a grid pattern (e.g., quilt pattern), co-linear rows of stitching, concentric circles, a spiral, and/or the like. In another implementation, the stitching pattern of any one of the stitch-consolidated assembly of plies is not uniform across the surface of the entire assembly. As described herein, the ballistic filler for the flexible body armor 110 includes a stitched consolidated region and a free ply region. In one implementation, the weight fraction of the stitch consolidated region is no greater than 50% the overall weigh of the ballistic filler. Further, the ballistic filler of the flexible body armor 110 includes at least one region of woven fabric stitched directly to unidirectional fabric.

To achieve a desired level of protection, the ballistic filler for the flexible body armor 110 is configured to inhibit the complete penetration of a particular ballistic threat by overcoming the energy associated with the ballistic event. Two examples of commercially available high strength fibers routinely used to generate anti-ballistic ply structures used in ballistic filler include para-aramid fiber, such as Kevlar® fiber from Dupont and Twaron® fiber from Teijin, and UHMWPE, including Spectra® fiber from Honeywell and Dyneema® fiber from DSM.

The performance of ballistic gear utilizing ply structures generated from high strength fiber is generally measured based on penetration resistance, as well as the resistance to back face deformation that can lead to blunt trauma injuries. Penetration resistance is routinely reported as the VSO, which is defined as the velocity at which a specific ballistic threat will penetrate an armor construction 50% of the time. A methodology routinely used for determining the VSO of a particular armor system against a specific threat is outlined in Mil-STD 662F VSO Ballistic test for Armor and Purchase Description FQ/PD 07-OSG, Body Armor, Multiple Threat/Interceptor Improved Outer Tactical Vest (IOTV) Generation Ill. The methodology for determining back face deformation is outlined in NIJ Standard 0101.06, Ballistic Resistance of Body Armor. As will be understood from the comparative and experimental examples provided herein, the ballistic filler for the flexible body armor 110 meets these standards and provides numerous advantages over monolithic and other hybrid designs. For example, the flexible body armor 110 is comfortable, durable, flexible, lightweight, and provides increased performance, including resistance to ballistic penetration, back face deformation performance, resistance to mechanical fatigue, and resistance to fragmentation threat, and the like.

Woven fabrics generated using para-aramid fiber have long demonstrated robust ballistic performance as anti-ballistic ply structures used in flexible armor systems. Woven anti-ballistic fabrics rely on mechanical interlacing of yarns using commercial weaving equipment and are a desired when designing systems that provide flexibility, comfort, conformability, and improved breathability. Additionally, the mechanically interlocked woven fabrics are very durable, requiring no adhesives or matrix resins to create the ballistic ply structure. Woven anti-ballistic fabrics and can undergo significant flexural fatigue without losing ballistic performance. Several investigations of flexible body armor fabricated using woven para-aramid fabrics reclaimed after more than a decade of continuous use in the field have demonstrated no ballistic performance loss when compared to the performance of the same designs when first issued.

While mechanical properties of UHMWPE fibers can significantly exceed those of para-aramid fibers such as Kevlar®, woven fabrics generated from UHMWPE fiber have routinely been observed to underperform para-aramid fabrics. One proposition for this observation is that the low friction coefficient of UHMWPE fibers greatly facilitates slip and translation of the warp and fill yarns at the point of impact in woven constructions made therefrom during the ballistic event. This significantly reduces yarn engagement of the ballistic threat, allowing it to pass through the woven structures with limited loading of the UHMWPE yarns.

Unidirectional laminates represent a second type of anti-ballistic ply structure used in the manufacture of flexible body armor systems. Unidirectional laminates are constructed from two or more layers of unidirectionally oriented high strength yarns adhesively bound together using matrix resins and optionally polymer films. The unidirectional fiber layers in the unidirectional laminate are cross-plied; having fiber direction of individual layers rotated 90 degrees relative to the neighboring layers they are laminated to. Unidirectional laminates have demonstrated improved ballistic VSO performance and improved back face deformation performance against high energy deformable projectiles such as bullet threats when compared to woven fabric systems for the same areal density. Disadvantages associated with the unidirectional laminate structure include reduced fragmentation threat resistance, increased stiffness and potentially reduced mechanical fatigue resistance when compared to woven structures generated with the same fiber.

Due to the aforementioned issue associated with its use in woven constructions, the unidirectional laminate was conventionally the preferred anti-ballistic structure for UHMWPE fiber. UHMWPE has found significant commercial success in soft armor systems when used in unidirectional laminate structures. These materials are commercially available under the trade names Spectra Shield® from Honeywell, or Dyneema® Unidirectional from DSM. These unidirectional laminate materials are generated using tacky adhesive matrix resins capable of overcoming the low surface friction and low surface energy of the UHMWPE fiber, resulting in mechanically stable anti-ballistic structures.

Hybrid designs containing woven para-aramid and either para-aramid or UHMWPE unidirectional laminates are disclosed. The hybrid designs provide improved flexibility at the expense of increased back face deformation compared to monolithic soft body armor designs comprised entirely of unidirectional laminates. Given the issues detailed above with the conventional materials, the ballistic filler of the flexible body armor 110 satisfies a long felt need in the ballistic gear industry and was developed from unexpected results. More particularly, V50 performance against deformable bullet threats and fragmentation threats in hybrid designs is largely governed by the V50 performance of the individual component materials weighted by their respective percent contribution in the hybrid design. The ballistic V50 performance of the hybrid design of the ballistic filler of the flexible body armor 110 is unexpected, among other reasons, based on the conventionally poor monolithic performance of the woven UHMWPE fabric as described above. Comparative and experimental examples are provided below to illustrate the unexpected and superior ballistic V50 performance of the flexible body armor 110.

Comparative Example 1

Three 15 inch×15 inch monolithic ballistic filler test panels were assemble using 32 plies of water repellent treated woven para-aramid fabric. The fabric was generated with 500 d Kevlar® KM2 Plus fiber having a plain weave construction with 28 ends per inch in the warp direction, and 28 picks per inch in the fill direction. The basis weight of the fabric was 3.61 oz/yd2. The areal density of the ballistic filler test panels was 0.80 lbs/ft2. The filler panels were stitched along corners with Kevlar® stitching thread to secure plies in place during testing. Each of the three panels was tested to determine the V50 against the Remington 9 mm FMJ bullet threat based on the testing protocol outlined in Purchase Description FQ/PD 07-05G, Body Armor, Multiple Threat/Interceptor Improved Outer Tactical Vest (IOTV) Generation Ill. The average of the V50s measured for the three replicate panels was 1486 ft/s.

Comparative Example 2

Three 15 inch×15 inch monolithic ballistic filler test panels were assemble using 15 plies of woven UHMWPE fabric. The fabric was generated with 288 denier Dyneema® UHMWPE fiber having a 5/1 twill weave construction with 21 ends per inch in the warp direction, and 20 picks per inch in the fill direction. The basis weight of the fabric was 8.50 oz/yd2 The fabric thickness was 19.8 mils and 0.50 mm. The fabric was supplied by JPS Composites of Greenville, SC as fabric style 17517. The areal density of the ballistic filler test panels was 0.84 lbs/ft2. The filler panels were stitched along corners with Kevlar® stitching thread to secure plies in place during testing. The average of the measured 9 mm FMJ bullet V50s for the three replicate panels was 469 ft/s.

Comparative Example 3

Three 15 inch×15 inch monolithic ballistic filler test panels were assemble using 18 plies of UHMWPE unidirectional laminate. The unidirectional laminate was supplied by DSM under the trade name Dyneema® SB117. The basis weight of the Dyneema® SB117 was 6.37 oz/yd2. The filler panels were stitched along corners with Kevlar® stitching thread to secure plies in place during testing. The areal density of the ballistic filler test panels was 0.80 lbs/ft2. The average of the measured 9 mm FMJ bullet V50s for the three replicate panels was 1997 ft/s.

Comparative Example 4

Three 15 inch×15 inch hybrid ballistic filler panels were assemble using the 500 d woven Kevlar® fabric described in example 1, and the Dyneema® SB117 unidirectional laminate described in example 3. The hybrid design consisted of a front (strike face) region comprising 7 plies of the 500 d woven Kevlar® fabric quilt stitched to 4 plies of the Dyneema® SB117 using Kevlar® thread in 2 inch diagonal square stitching pattern. The quilted region was backed by 10 plies of Dyneema® SB117 and the filler panels were stitched along corners with Kevlar stitching thread to secure plies in place during testing. The weight percent of woven Kevlar® fabric in this design was 22.1 wt %. The areal density of the ballistic filler test panels was 0.81 lbs/ft2. Each of the three panels was tested to determine the V50 against the Remington 9 mm FMJ bullet threat. The average of the V50s measured for the three replicate panels was 1863 ft/s.

Experimental Example

Three 15 inch×15 inch hybrid ballistic filler panels were assemble using the woven Dyneema® UHMWPE fabric described in Comparative Example 2, and the Dyneema® SB117 unidirectional laminate described in example 3. The hybrid design consisted of a front (strike face) region comprising 3 plies of the woven Dyneema® UHMWPE fabric 500 d Kevlar fabrics quilt stitched to 4 plies of the Dyneema® S8117 using Kevlar® thread in 2 inch diagonal square stitching pattern. The quilted region was backed by 10 plies of Dyneema® S8117 and the filler panels were stitched along corners with Kevlar® stitching thread to secure plies in place during testing. The weight percent of woven UHMWPE fabric in this design was 21.4 wt %. The areal density of the ballistic filler test panels was 0.81 lbs/ft2. Each of the three panels was tested as before to determine the V50 against the Remington 9 mm FMJ bullet threat. The average of the V50s measured for the three replicate panels was 1880 ft/s. These results indicate improved average 9 mm FMJ V50 performance over that of Comparative Example 4 having similar ply arrangement, and roughly the same areal density and woven fabric content. This result is unanticipated based on the poor monolithic 9 mm FMJ V50 performance of the woven UHMWPE fabric panels presented in Comparative Example 2.

While the present disclosure has been described with reference to various implementations, it will be understood that these implementations are illustrative and that the scope of the disclosure is not limited to them. Many variations, modifications, additions, and improvements are possible. More generally, implementations in accordance with the present disclosure have been described in the context of particular examples. Functionality may be separated or combined in blocks differently in various implementations of the disclosure or described with different terminology. These and other variations, modifications, additions, and improvements may fall within the scope of the disclosure as defined in the claims that follow.

What is claimed is:

1. A flexible body armor ballistic filler comprising:

a first subpanel comprising a plurality of layers of flexible ballistic woven fabric generated from a high strength yarn;

a second subpanel backing the first subpanel, the second subpanel comprising a plurality of layers of unidirectional ballistic fabric generated from ultrahigh molecular weight polyethylene yarn the first subpanel stitched to the second subpanel to form a first panel; and a second panel comprising a plurality of layers of unidirectional ballistic fabric generated from ultrahigh molecular weight polyethylene yarn, the plurality of layers being stitched tougher;

a third panel comprising one or more unstitched ballistic ply structures generated from the high strength yarn, wherein the first panel, the second panel and the third panel are stitched together at a proximate end and a distal end to define a ballistic filler assembly.

2. The flexible body armor ballistic filler of claim 1, wherein an edge tape is applied to the to a portion of a periphery of the ballistic filler assembly.

3. The flexible body armor ballistic filler of claim 1, wherein the ballistic filler assembly has a profile to match a ballistic plate.

4. The flexible body armor ballistic filler of claim 1, further comprises a framework that is exterior to the ballistic filler assembly.

5. The flexible body armor ballistic filler of claim 4, wherein the framework is disposed adjacent the ballistic filler assembly.

6. The flexible body armor ballistic filler of claim 4, wherein the framework provides structural integrity to the ballistic filler assembly.

7. The flexible body armor ballistic filler of claim 4, wherein the framework prevents sagging of the ballistic filler assembly.

8. The flexible body armor ballistic filler of claim 4, wherein the framework has a profile that is complimentary to the profile of the ballistic filler assembly.

* * * * *